US005193464A

United States Patent [19]

Morden

[11] Patent Number: 5,193,464

[45] Date of Patent: Mar. 16, 1993

[54] POLYMER PALLET LEG FOR A CARDBOARD PALLET BASE

[75] Inventor: Roy Morden, Orangeville, Canada

[73] Assignee: Plastic Pallet Systems, Inc., Minneapolis, Minn.

[21] Appl. No.: 691,449

[22] Filed: Apr. 25, 1991

[51] Int. Cl.[5] ..... B65D 19/18

[52] U.S. Cl. ..... 108/56.3; 108/53.3; 108/901

[58] Field of Search ..... 108/51.1, 56.1, 56.3, 108/901; 248/188, 678, 346, 188.8, 188.9

[56] References Cited

U.S. PATENT DOCUMENTS

| | | | |
|---|---|---|---|
| 3,401,908 | 9/1968 | Rapata | 248/188.8 |
| 3,438,342 | 4/1969 | Woolworth et al. | 108/56.3 |
| 3,590,751 | 7/1971 | Freid | 108/56.3 X |
| 3,664,272 | 5/1972 | Sanders | 108/53.3 |
| 3,685,463 | 8/1972 | Francis | 108/56.3 |
| 3,804,032 | 4/1974 | Baucom | 108/56.3 |
| 3,915,099 | 10/1975 | Wies et al. | 108/53.3 X |
| 4,267,781 | 5/1981 | Powers | 108/56.3 X |

*Primary Examiner*—Peter A. Aschenbrenner
*Attorney, Agent, or Firm*—Hugh D. Jaeger

[57] ABSTRACT

A polymer pallet leg for a cardboard pallet base including a first truncated cone, a second truncated cone within said first truncated cone inversely positioned with respect thereto, a rim surrounding and offset below a top edge of said first truncated cone, and a plurality of locking tabs extending outwardly from a top edge of the first truncated cone. The locking tabs engage with corresponding tab holes of a cardboard pallet about a pallet leg hole. The second truncated cone includes a flat surface for engaging with any object placed on the pallet and is about the same height as the top edge of the first truncated cone. An optimal braking tab can also be provided for engaging the cardboard further locking the leg in position. A pallet leg insert engages into the second inverted cone for attaching a bottom pallet base to the polymer pallet legs.

5 Claims, 9 Drawing Sheets

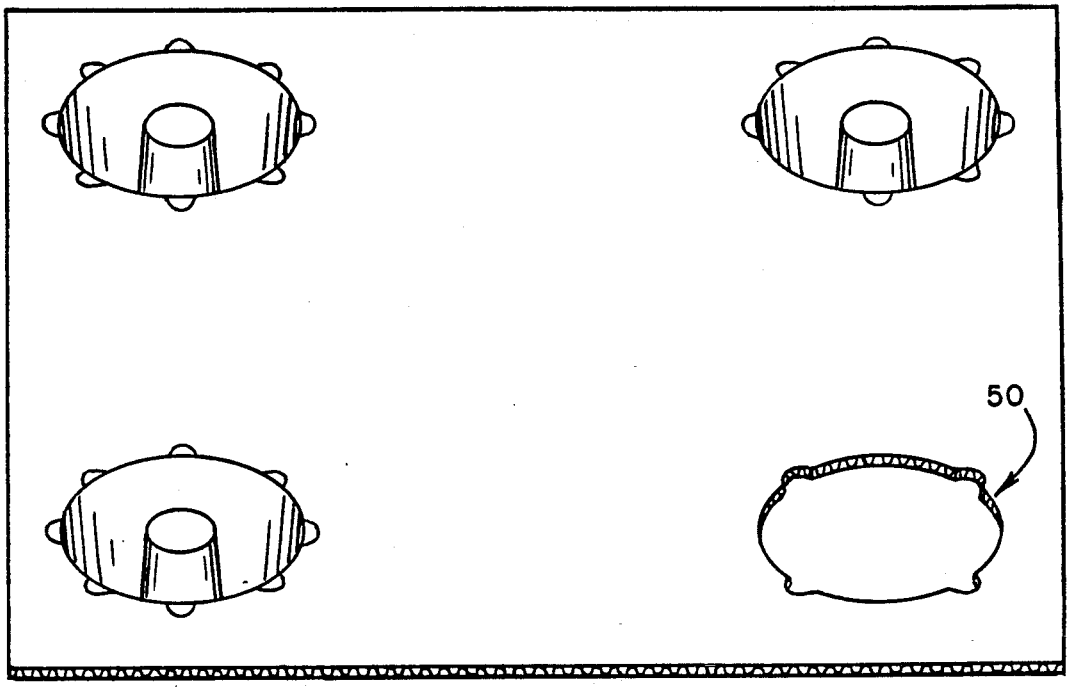
FIG. 4
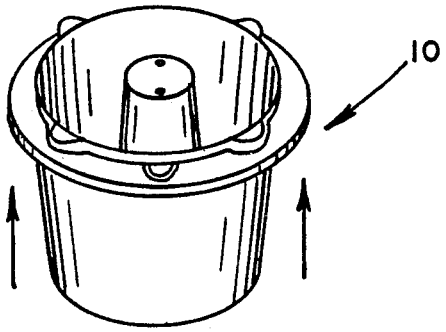

POLYMER PALLET LEG FOR A CARDBOARD PALLET BASE

CROSS REFERENCES TO CO-PENDING APPLICATIONS

This application is a Continuation-in-Part of Canadian Patent Application No. 2030222, filed Nov. 19, 1990, entitled "Polymer Pallet Leg for a Cardboard Pallet Base", assigned to the same assignee as this patent application.

BACKGROUND OF THE INVENTION

1. Field of the Invention

The present invention pertains to a polymer pallet leg for a cardboard pallet base, and more particularly, pertains to a process and apparatus for using a plurality of polymer pallet legs for supporting a cardboard pallet base, usually a corrugated cardboard sheet to form a pallet support system. A pallet base insert is also provided for a pallet base and for a polymer pallet leg.

2. Description of the Prior Art

With environmental concerns, wooden pallets have become undesirable because of the problems of disposing of wooden pallets, the cost of wooden pallets, and most importantly, landfills not accepting wooden pallets as wooden pallets are not environmentally recyclable. Wooden pallets quickly fill up a landfill, do not degrade promptly and generally have become a burden upon the ecological society because of the filling up landfills with bulky substance. Further, wooden pallets cause the destruction of trees which is also not feasible from an ecological standpoint.

Prior art polymer pallet legs such as that in U.S. Pat. No. 3,915,099 by Wies, et al., issued on Oct. 28, 1975, for Support Column and Disposable Pallet Structure are limited in the "unit weight per surface area," as well as the statics and dynamics because of a single cup supporting-like structure with no backup or inverse-like supporting structure. The mass transfer is located from a leg and interrupted rim down through the cup to a base, and does not include any like inverse supporting relationship. This has static and dynamic limitations and structural concern, and can lead to structural static and dynamic failures.

The present invention overcomes the disadvantages of the prior art by providing a polymer pallet leg which includes a supporting structure and inverse supporting structure. The polymer pallet leg is of a polymer recyclable material. A pallet leg insert is provided to attach a pallet leg base for further weight distribution, conveying, or handling of the pallet system with the polymer pallet leg, the top pallet base, the bottom pallet base and the pallet leg insert.

THE INVENTION

The general purpose of the present invention is a polymer pallet leg for a recyclable pallet system, including a recyclable polymer pallet leg, and a recyclable corrugated cardboard pallet sheet or pallet surface. The polymer legs engage into and lock into a pallet surface, and integrate to form a pallet system. One of the interesting aspects and features of the pallet system is that the pallet leg can be reground to form new pallet legs, and the pallet sheet can be recycled to form new pallet sheets. Therefore, there is no need to scrap or throw away either the polymer plastic legs or the corrugated cardboard pallet sheets, as both can be recycled to again be manufactured into recycled components of the plastic leg and the pallet sheet of the pallet system. The entire pallet system can be made again from recycled materials. A pallet leg insert is provided to attach a pallet base bottom to the bottom of the polymer pallet leg. The combinations of the top base and/or bottom base, the polymer pallet leg, and the polymer leg insert forms the pallet system.

According to one embodiment of the present invention, there is provided a polymer plastic leg including a truncated cone with a base and an expanding cylinder wall extending upwardly, a rim extending thereabout with a downwardly extending lip spaced below a top edge of said wall, a plurality of locking tabs extending outwardly from a top edge, an inverse cone positioned within the truncated cone and including a top surface in a same plane as the locking tabs, whereby the top surface of the inverse cone, as well as the locking tabs, support an object placed upon the pallet sheet. The polymer pallet leg engages into four locking tab holes. The rim engages the bottom surface of the pallet. There can also be provided a brake tab for engaging up against and into the corrugated surface of the pallet sheet, and for locking the polymer plastic leg into position. A certain amount of corrugated cardboard is displaced which is caused by the engagement of the brake tab. The bottom surface cardboard pallet rests on the rim. The top surface of the inner cone engages the bottom surface of any goods placed on the pallet for additional support. A pallet base insert is also provided for frictional engagement with the polymer pallet leg for distributing the weight of the polymer pallet leg over a bottom pallet base and also for increasing the bottom surface area of the polymer pallet leg. The bottom pallet base also provides for conveying, handling and any other requirements for a bottom pallet base.

Significant aspects and features of the present invention include a polymer pallet leg which is three dimensional in static and dynamic stability, including a lower support surface for base support and an upper support surface for object support at the plane of the pallet.

Another significant aspect and feature of the present invention is a polymer pallet leg which is easily utilizable by any individual for engagement with a pallet sheet, and which can be readily engaged and disengaged from the pallet sheet for recycling.

A further significant aspect and feature of the present invention is a polymer pallet leg which is recyclable, as well as a recyclable pallet support sheet. The entire pallet system is recyclable.

An additional significant aspect and feature of the present invention is a pallet base insert for engagement into the polymer pallet leg to provide a larger base surface area, especially for passage across a conveyor system or for handling.

Having thus described the preferred embodiments of the present invention, it is a principal object hereof to provide a polymer pallet leg for use with a corrugated cardboard sheet or a wafer board which in combination is a recyclable and ecology minded pallet support system.

One object of the present invention is a polymer pallet leg which is readily usable with a pallet sheet of the pallet system, and which is also recyclable and cost effective.

Another object of the present invention is a polymer pallet leg which is stackable within other like polymer pallet legs prior to and after use.

A further object of the present invention is to provide a pallet leg insert for attachment of a base to the bottom of the polymer pallet leg.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein:

FIG. 4 illustrates a perspective view of the polymer pallet leg utilized with a corrugated cardboard pallet sheet to form a pallet system;

Figure 1:
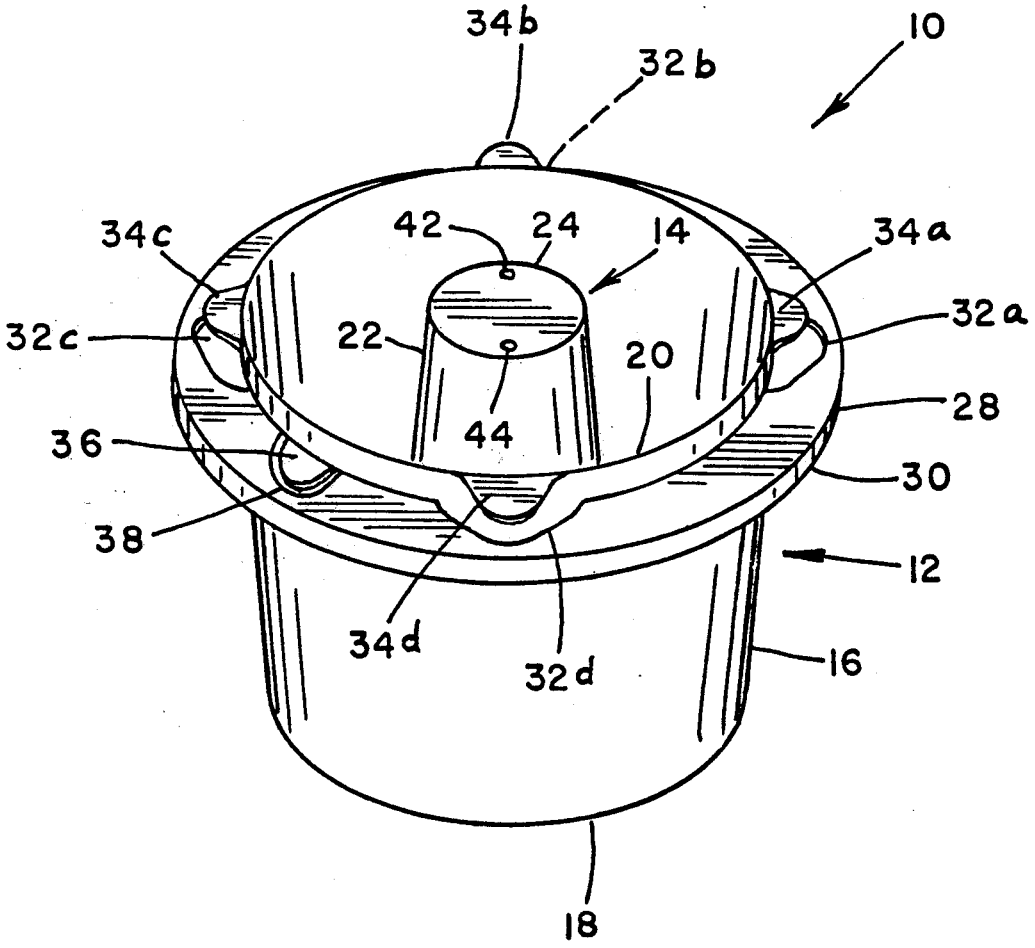
FIG. 1 illustrates a perspective view of a polymer pallet leg, the present invention.

10 polymer pallet leg
12 truncated cone
14 inverse truncated cone
16 extending side
18 base
20 top edge
22 inverse extending side
24 top surface
26 base edge
28 rim
30 downwardly extending edge
**32*a*–32*n*** locking tab mold holes
**34*a*–34*n*** locking tabs
36 fifth locking tab
38 locking tab hole
**40*a*–40*d*** holes
42 optimal mold release hole
50 cardboard top pallet base
70 pallet leg insert
72 planar member
74 beveled edge
76 tubular member
**78*a*–*d*** segmented gripping members
**80*a*–*c*** arcular grooves
82 beveled surface
85 inner circumference
**84*a*–*d*** spaces
86 bottom pallet base
88 hole
90 annular rib or ring

DESCRIPTION OF THE PREFERRED EMBODIMENTS

Figure 2:
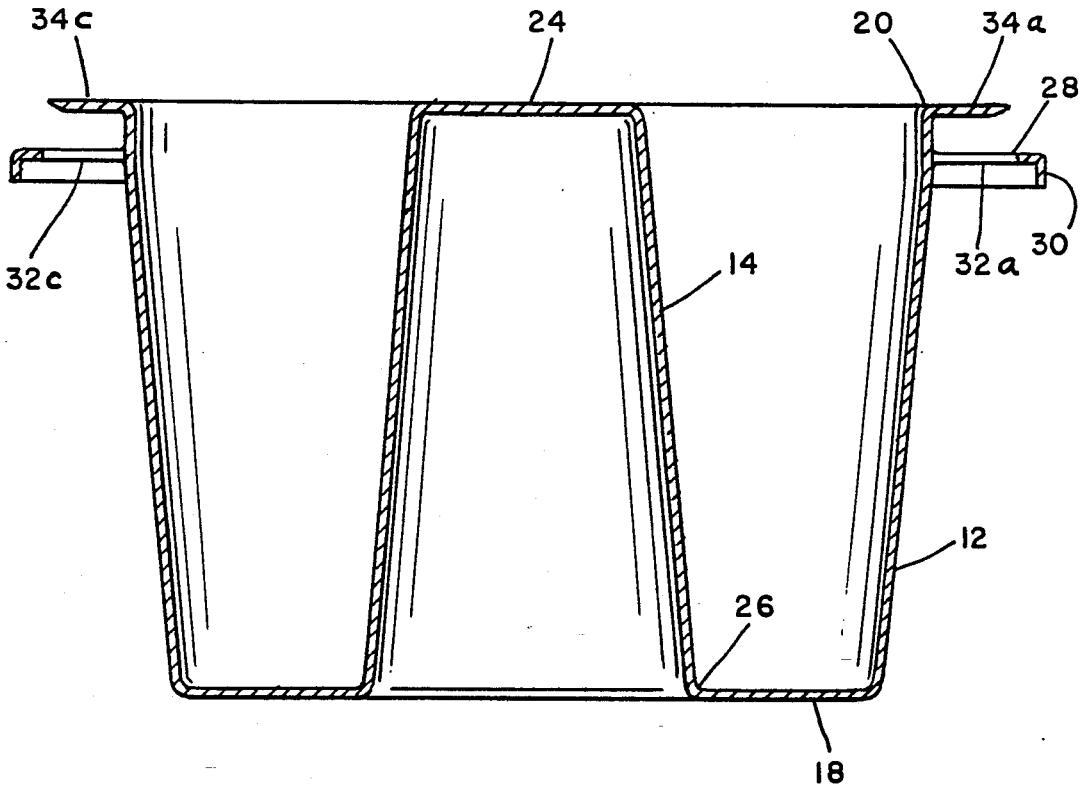
FIG. 2 illustrates a cross-sectional view of the present invention.
Figure 3:
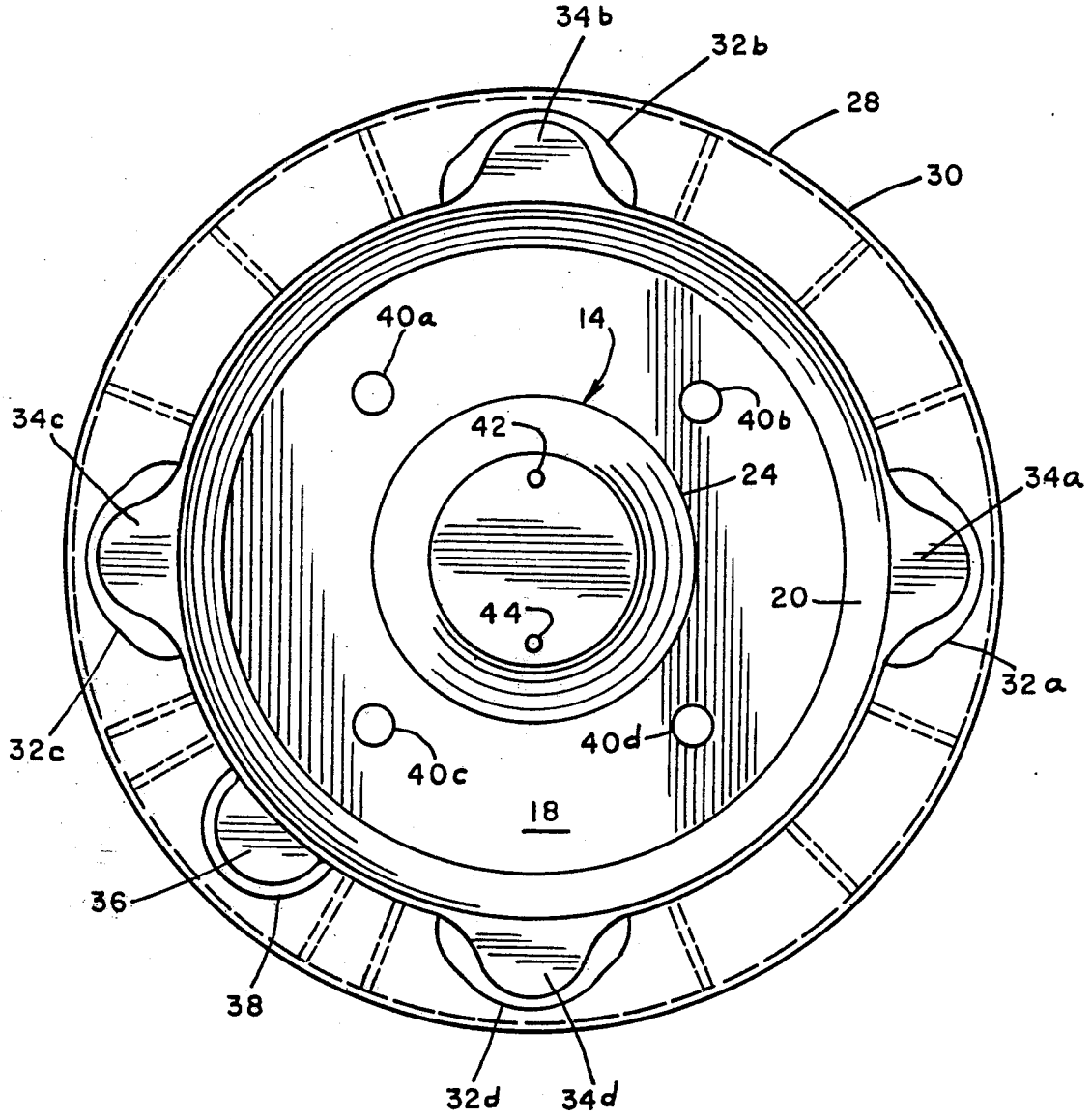
FIG. 3 illustrates a top view of the present invention.
Figure 5:
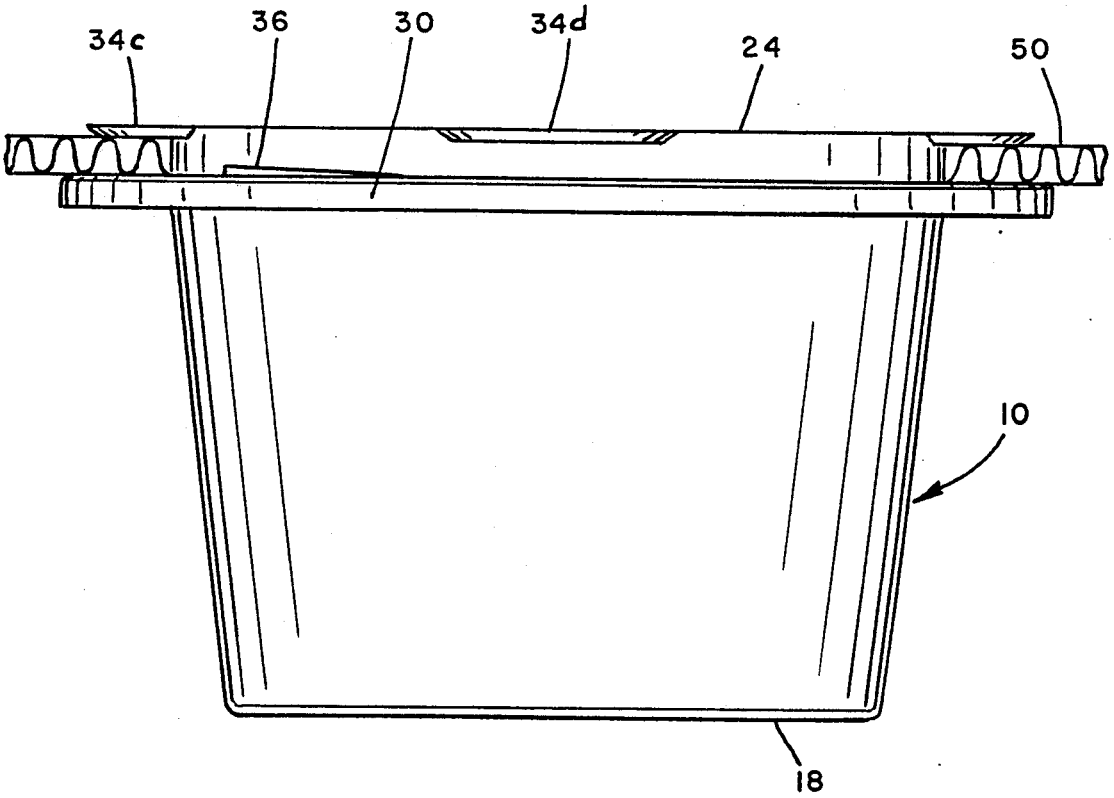
FIG. 5 illustrates a side view of the lower right corner of FIG. 4.

FIG. 1 illustrates a perspective view of a polymer pallet leg 10 of the present invention, including a truncated cone 12 and an inverse truncated cone 14. The first truncated cone includes an extending side 16, a base 18, and a top edge 20. The inverse truncated cone 14 includes an inverse extending side 22, a top surface 24, and a base edge 26 as illustrated in FIG. 2. The height of the top surface 24 is about the same or equal to the height of the top edge 20. A rim 28 with a downwardly extending edge 30, and spaced from the top edge as illustrated in FIG. 3, extends about the top edge 20 and includes locking tab mold holes **32*a*–32*d*. Locking tabs 34*a*–34*d* extend outwardly about the top edge 20. An optional fifth brake tab 36 with a corresponding locking tab hole 38** is provided to engage upwardly and into the corrugated cardboard surface as illustrated in FIG. 5 and as later described in detail.

FIG. 2 illustrates a cross-sectional view where all numerals correspond to those elements previously described.

FIG. 3 illustrates a top view where all numerals correspond to those elements previously described. Holes **40*a*–40*d* are in the base 18**.

MODE OF OPERATION

FIG. 4 illustrates a perspective view of the polymer pallet leg 10 for insertion into a top cardboard or chip board pallet base 50. The polymer leg 10 is inserted into a top pallet base 50 in the lower right hole in the cardboard pallet to form the pallet, along with three other holes to retain the polymer pallet legs. Operation for insertion only requires a push of the polymer pallet leg 10 and a twist of the leg 10 for assembly to install the polymer pallet leg 10. The top pallet base 50 can be made of any suitable recyclable material.

FIG. 5 illustrates a side view of the lower right hand corner of FIG. 4 where all numerals correspond to those elements previously described. Illustrated in particular is the brake tab 36 which is angled up slightly from the planar surface of the rim 28 to frictionally engage the lower surface of the cardboard top pallet base 50.

DESCRIPTION OF THE FIRST ALTERNATIVE EMBODIMENT

Figure 6:
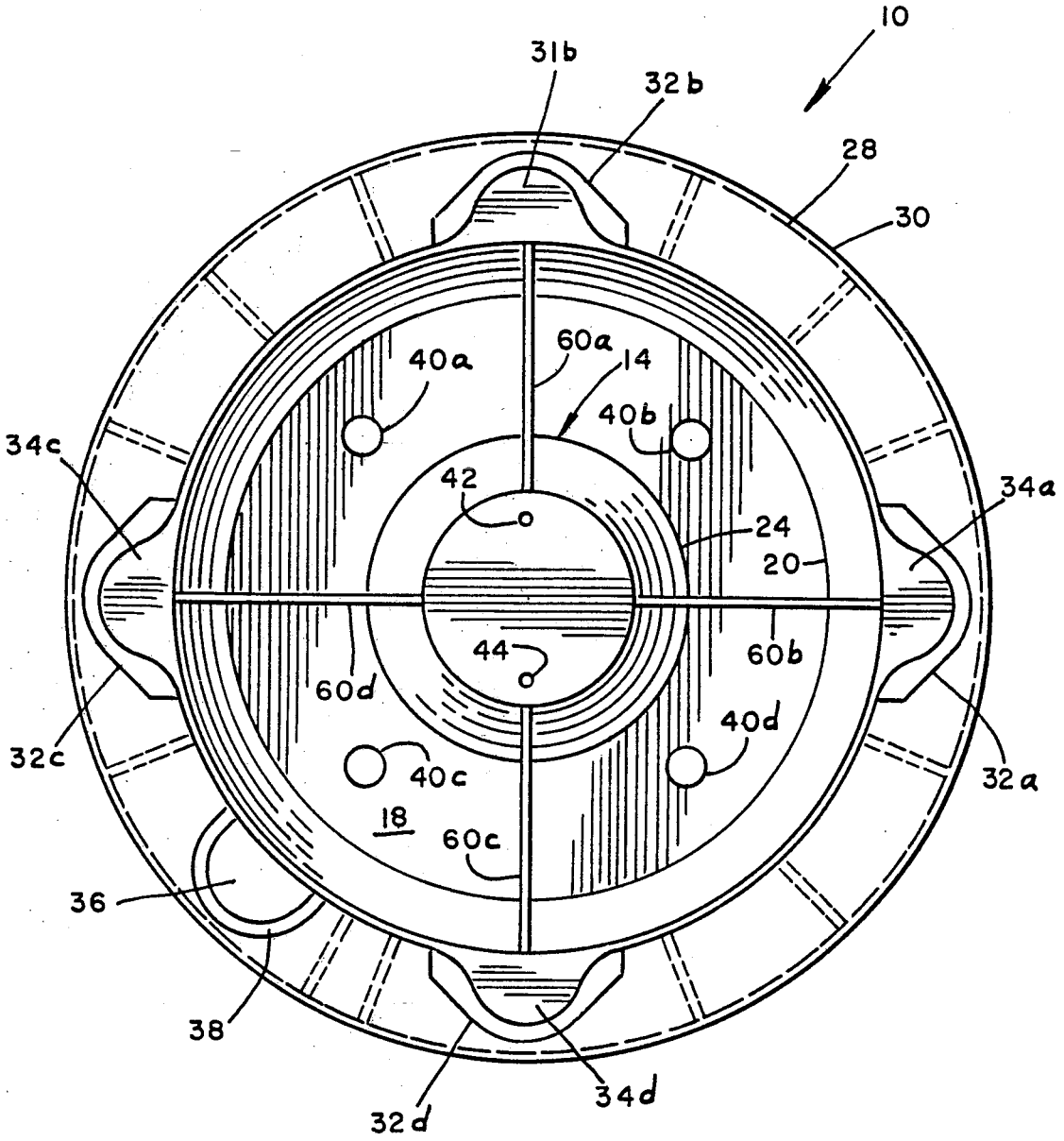
FIG. 6 illustrates a top view of a first alternative embodiment.

FIG. 6 illustrates a top view of an alternative embodiment of a polymer pallet leg with a plurality of vertical supports **60*a*–60*n*** connecting the cones together. The vertical supports tie the inner cone to the outer cone providing still further structural stability between the cones.

The height of the top surface 24 can be about equal to that of the top surface of the locking tabs 34, and can also be slightly higher or slightly lower than the top surface of the locking tabs as may be predetermined. Hole 42 and 44 release vacuum suction which can occur between the inner cones when the legs are stacked together. The pallet can be of any other suitable materials, such as corrugated plastic, a polymer sheet, chip board, plywood, etc. The distance between the locking tabs and the rim is determined by the thickness of the pallet base. The plastic pallet leg can also be color coded, as well as the pallet base for designation of the type of goods, the designation of manufacturer, etc.

DESCRIPTION OF THE SECOND ALTERNATIVE EMBODIMENT

Figure 7:
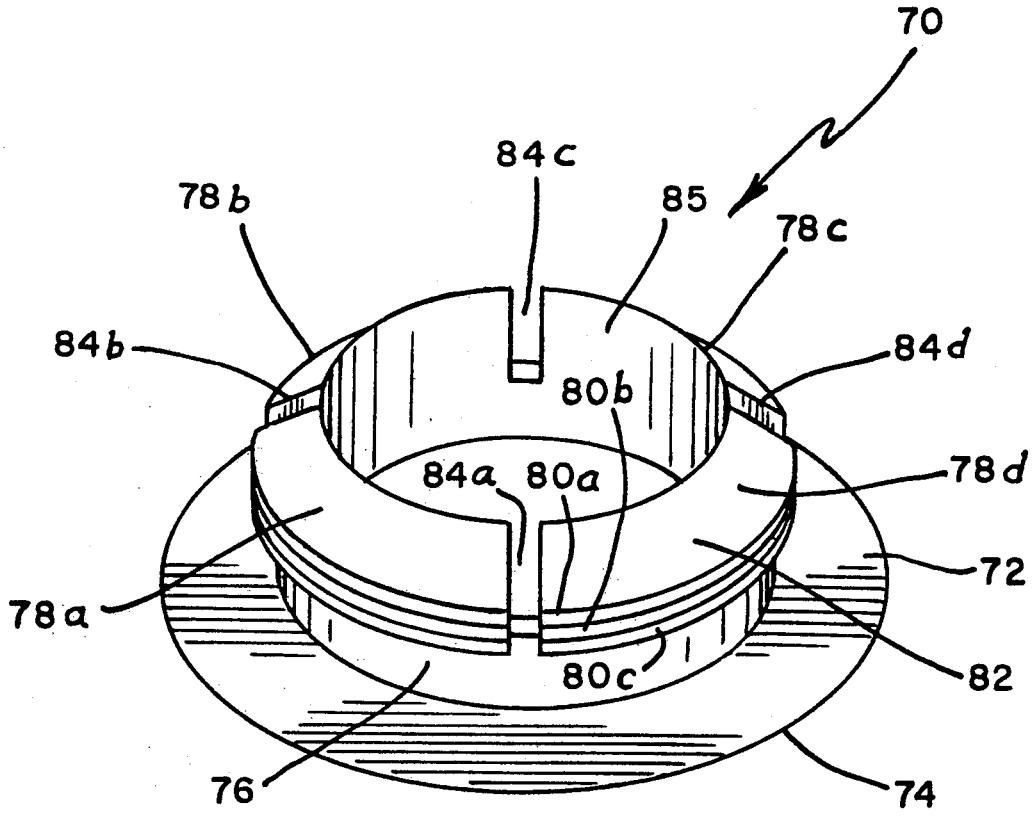
FIG. 7 illustrates a perspective view of a pallet leg insert, a second alternative embodiment.
Figure 8:
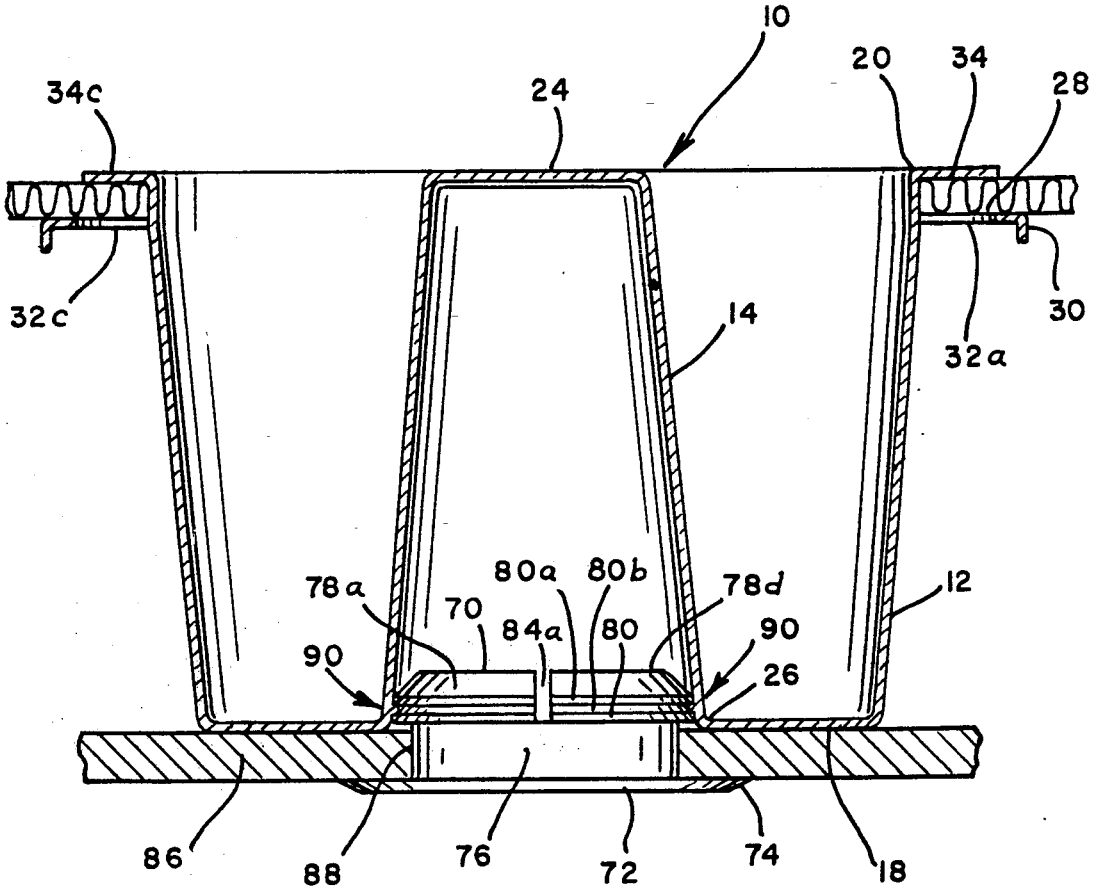
FIG. 8 illustrates a bottom pallet base secured to a pallet leg by the polymer pallet leg insert of FIG. 7; and, FIG. 9 illustrates the groove-to-ring engagement of the polymer pallet leg insert to the polymer pallet leg with a bottom pallet base therebetween.

FIG. 7, a second alternative embodiment, illustrates a perspective view of a pallet leg insert 70 for securing a planar pallet bottom base member as later described for a series or group of pallet legs 10. The pallet leg insert 70 includes a planar member 72 formed as a circle which includes a beveled edge 74, as illustrated in FIG. 8. A tubular member 76 extends upwardly at a right angle from the planar member 72. A plurality of like segmented gripping members 78*a*, 78*b*, 78*c* and 78*d* extend outwardly and upwardly from the upper portion of the tubular member 76, each containing a plurality of arcular grooves including arcular grooves 80*a*, 80*b* and 80*c* and a beveled surface 82 extending from the top of the groove 80*a* to the inner circumference 85 of the tubular member 76. Arcular grooves 80*a*–80*c* in each of the segmented gripping members 78*a*–78*d* snappingly engage with frictional engagement a ring in the lower inner portion of the pallet leg 10 as later described in detail. Spaces 84*a*–84*d* between the segmented gripping members 78*a*–78*d* allow for inward flexing of the segmented gripping members 78*a*–78*d* for ease of engagement with the pallet leg 10. The beveled surface 82 allows for ready alignment and ingress to the pallet leg 10. Three arcular grooves 80*a*–80*c* are illustrated by way of example and for the purpose of illustration only, and is not to be construed as limiting of the scope of the present invention.

FIG. 8 illustrates the pallet leg insert 70 securing a bottom pallet base 86 to the base 18 of the pallet leg 10. A hole 88 is drilled in the bottom pallet base 86. The segmented gripping members 78*a*–78*d* are forcibly maneuvered through the hole 88 in the bottom pallet base 86. Any of the set of arcular grooves 80*a*–80*c* in the segmented gripping members 78*a*–78*d* snappingly engage an annular rib or ring 90 at the base of the inverted truncated cone 14, thus holding and securing the bottom pallet base 86 between the planar member 72 and the base 18 of the pallet leg 10. Any number of internal rings or internal rims 90 may be used in succession for engagement with one or more of the plurality of arcular grooves 80*a*–80*c*. One ring only is illustrated by way of example only, and is not deemed to be limiting of the scope of the present invention.

Figure 9:
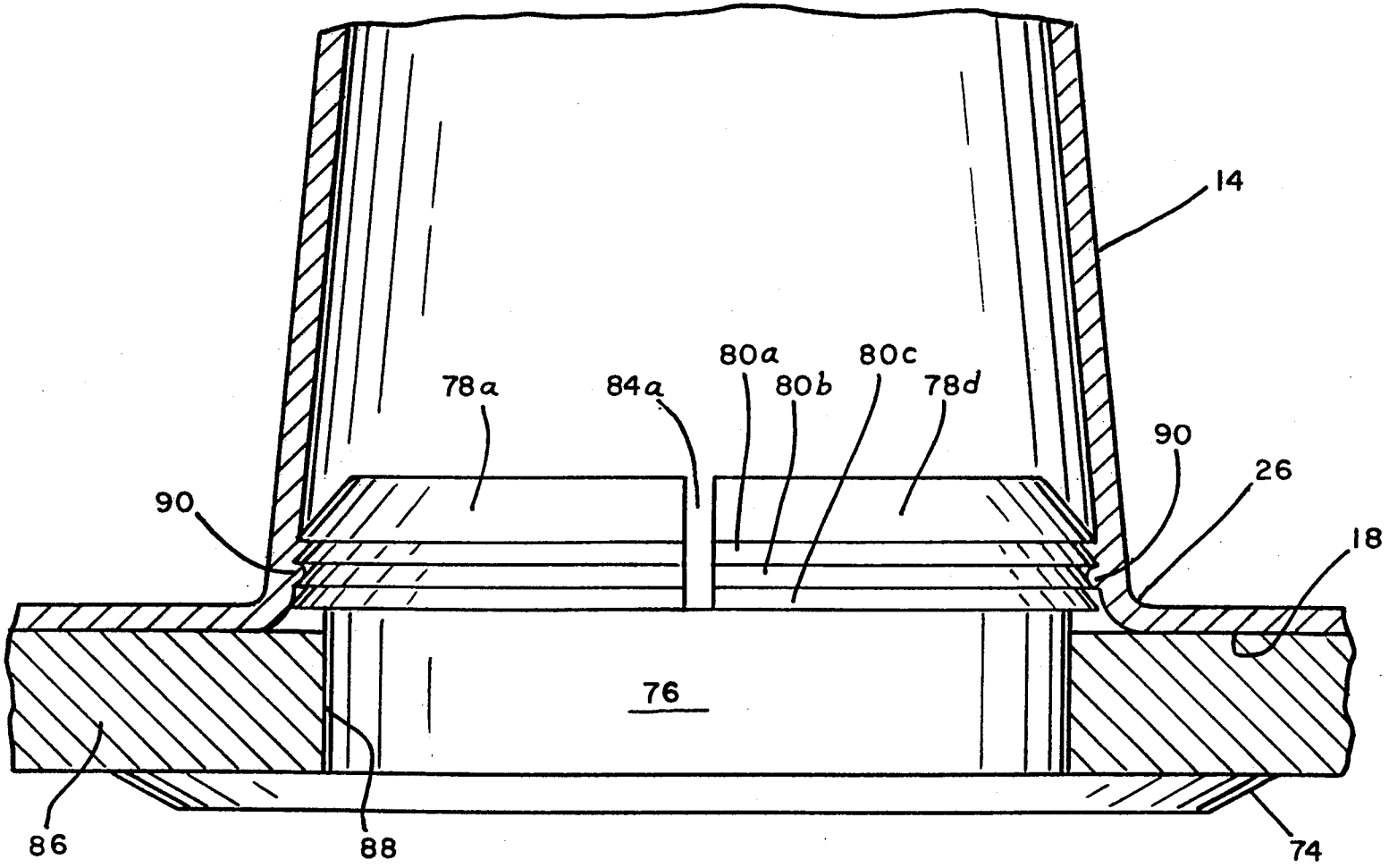

FIG. 9 illustrates the engagement of arcular groove 80*b* with the annular rib or ring 90 at the base of the truncated inverted cone 14 where all numerals correspond to those elements previously described.

Various modifications can be made to the present invention without departing from the apparent scope hereof.

I claim:

1. A leg of a plurality of legs for engaging with a cardboard base to form a pallet comprising:

a. a first truncated cone including a rim about said cone;

b. at least one locking tab ending outwardly from said truncated cone;

c. a second truncated cone within said first truncated cone having a top lying generally in a plane with the locking tab.

2. A polymer pallet leg comprising:

a. a first truncated cone of a first height including a top edge;

b. a rim spaced below said top edge;

c. a plurality of locking tabs extending outwardly from said top edge; and, d. a second truncated cone inversely positioned within said first cone having a second height generally equal to the first height and having a load-bearing top surface.

3. In combination, a polymer pallet leg and a pallet sheet comprising:

a. a polymer pallet leg including a first truncated cone including a top edge, a rim spaced below said top edge, a plurality of locking tabs extending outwardly from said top edge, and a second truncated cone having a load-bearing top surface of a height generally equal to the fist truncated cone inversely positioned within said first cone; and, b. a pallet sheet including a hole with locking tab slots for receiving and locking said polymer pallet leg into said pallet sheet so that the top surface of the second cone is in position within the hole for load bearing.

4. A polymer pallet leg comprising:

a. a first truncated cone including a top edge;

b. a rim below said top edge;

c. a plurality of locking tabs extending outwardly from said top edge;

d. a second truncated cone inversely positioned within said first cone having a top surface lying generally in a plane with the top edge of the first truncated cone; and, e. vertical members extending between said first cone and said second cone.

5. In combination, a polymer pallet leg, a pallet sheet, a pallet base, and a pallet leg insert comprising:

a. a polymer pallet leg including a first truncated cone including a top edge, a rim spaced below said top edge, a plurality of locking tabs extending outwardly from said top edge, and a second truncated cone inversely positioned within said first cone having a load-bearing top surface generally level with the top edge, and including a lower internal rim;

b. a pallet sheet including holes with locking tab slots for receiving and locking said polymer pallet legs into said pallet sheet; and, c. a pallet leg insert including engaging means engaged into a pallet base and frictionally engaged about said rim into said second truncated cone.

* * * * *